US009364851B2

(12) United States Patent
Tang et al.

(10) Patent No.: US 9,364,851 B2
(45) Date of Patent: Jun. 14, 2016

(54) ROLLER COATING METHOD FOR PRODUCTION OF PATTERNED INSULATION BOARD USED FOR BUILDING EXTERIOR WALL

(71) Applicant: LIAONING CHAOSHUO TOMA TECHNOLOGY STEEL PLATE PRINTING CO., LTD., Yingkou, Liaoning (CN)

(72) Inventors: Yueping Tang, Yingkou (CN); Jianping Zhou, Yingkou (CN); Liang Wu, Yingkou (CN)

(73) Assignee: LIAONING CHAOSHUO TOMA TECHNOLOGY STEEL PLATE PRINTING CO., LTD., Yingkou (CN)

( * ) Notice: Subject to any disclaimer, the term of this patent is extended or adjusted under 35 U.S.C. 154(b) by 0 days.

(21) Appl. No.: 14/385,079

(22) PCT Filed: Jun. 28, 2013

(86) PCT No.: PCT/CN2013/078422
§ 371 (c)(1),
(2) Date: Sep. 12, 2014

(87) PCT Pub. No.: WO2014/146378
PCT Pub. Date: Sep. 25, 2014

(65) Prior Publication Data

US 2015/0174606 A1 Jun. 25, 2015

(30) Foreign Application Priority Data

Mar. 19, 2013 (CN) ..... 2013 1 0089178

(51) Int. Cl.
*B05D 1/28* (2006.01)
*B05D 1/02* (2006.01)

(Continued)

(52) U.S. Cl.
CPC ... *B05D 1/02* (2013.01); *B41F 9/01* (2013.01); *B41F 13/0045* (2013.01);

(Continued)

(58) Field of Classification Search
CPC ..... B05D 1/02; B05D 1/28
See application file for complete search history.

(56) References Cited

U.S. PATENT DOCUMENTS 1,999,413 A * 4/1935 Hemming et al. ..... 156/237
RE25,134 E * 3/1962 Kinzelman ..... 101/178

(Continued)

FOREIGN PATENT DOCUMENTS

CN 1452669 A 10/2003
CN 201592348 U 9/2010

(Continued)

OTHER PUBLICATIONS

Dec. 26, 2013 Search Report issued in International Application No. PCT/CN2013/078422.

*Primary Examiner* — Nathan Empie
(74) *Attorney, Agent, or Firm* — Oliff PLC

(57) ABSTRACT

The present invention provides a roller coating method for production of patterned insulation board used for building exterior wall. In this method, a metal veneer and a substrate are produced firstly, and a pattern is printed on the metal veneer, and then an insulation layer is added between the metal veneer and the substrate to produce the patterned insulation board which is finally arranged onto the wall body. In this way, the defect that an decorative layer has to be arranged after installation of an insulation board is avoided (it is inconvenient to directly print a pattern on the insulation board arranged on the wall body by making use of the roller coating production line, so the existing insulation board is generally less decorative and unaesthetic), and the integration of decoration and insulation is realized.

7 Claims, 1 Drawing Sheet

(51) Int. Cl.

| | |
|---|---|
| ***B44C 1/24*** | (2006.01) |
| ***B41F 33/00*** | (2006.01) |
| ***B41F 33/02*** | (2006.01) |
| ***B41F 9/01*** | (2006.01) |
| ***B41F 13/004*** | (2006.01) |
| ***B41F 13/14*** | (2006.01) |
| ***B41F 23/00*** | (2006.01) |
| ***B41F 23/04*** | (2006.01) |
| ***B41F 23/08*** | (2006.01) |
| ***B44C 5/04*** | (2006.01) |
| ***B41F 35/00*** | (2006.01) |
| ***B41F 17/00*** | (2006.01) |
| *B41M 1/28* | (2006.01) |

(52) U.S. Cl.

CPC ..... *B41F 13/14* (2013.01); *B41F 17/00* (2013.01); *B41F 23/002* (2013.01); *B41F 23/007* (2013.01); *B41F 23/0403* (2013.01); *B41F 23/0476* (2013.01); *B41F 23/08* (2013.01); *B41F 33/0036* (2013.01); *B41F 33/02* (2013.01); *B41F 35/00* (2013.01); *B44C 1/24* (2013.01); *B44C 5/0415* (2013.01); *B41M 1/28* (2013.01); *B41P 2213/90* (2013.01); *B41P 2235/246* (2013.01)

(56) References Cited

U.S. PATENT DOCUMENTS

| | | | | | |
|---|---|---|---|---|---|
| 3,106,503 | A | * | 10/1963 | Randall et al. | 156/290 |
| 5,698,058 | A | * | 12/1997 | Tognelli | 156/259 |
| 6,835,272 | B1 | | 12/2004 | Lee | |
| 2002/0186980 | A1 | * | 12/2002 | Tsuruya et al. | 399/49 |
| 2003/0021613 | A1 | * | 1/2003 | Koide | 399/167 |
| 2003/0059643 | A1 | * | 3/2003 | Kim et al. | 428/626 |
| 2003/0079629 | A1 | | 5/2003 | Albert et al. | |
| 2011/0258944 | A1 | * | 10/2011 | Radoane | 52/62 |

FOREIGN PATENT DOCUMENTS

| | | | | |
|---|---|---|---|---|
| CN | 101912839 | A | * | 12/2010 |
| CN | 201661035 | U | * | 12/2010 |
| CN | 102990360 | A | | 3/2013 |
| CN | 102991113 | A | | 3/2013 |
| CN | 102991123 | A | | 3/2013 |
| CN | 103029502 | A | | 4/2013 |
| CN | 103147670 | A | | 6/2013 |
| CN | 103158339 | A | | 6/2013 |
| CN | 103158380 | A | | 6/2013 |
| CN | 103158381 | A | | 6/2013 |
| CN | 103158415 | A | | 6/2013 |
| CN | 202965490 | U | | 6/2013 |
| DE | 29716408 | U1 | * | 11/1997 |
| JP | 2000-079677 | A | | 3/2000 |

* cited by examiner

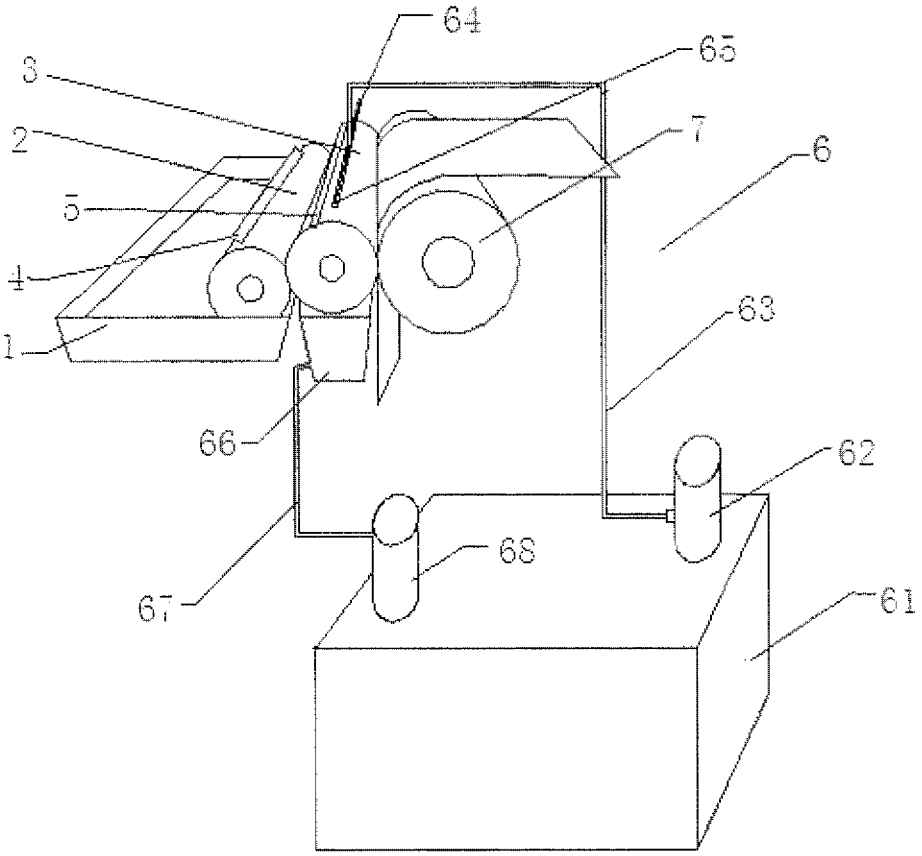
64
65
3
2
7
6
5
4
1
63
66
62
68
67
61

ROLLER COATING METHOD FOR PRODUCTION OF PATTERNED INSULATION BOARD USED FOR BUILDING EXTERIOR WALL

FIELD OF INVENTION

The present invention relates to a roller coating method for production of patterned insulation board used for building exterior wall, belonging to the field of patterned insulation board manufacturing.

BACKGROUND OF THE INVENTION

It is future development trend to manufacture and use green building materials to construct green buildings in the construction field. A concept of "promoting green development, cyclic development, low-carbon development" and "Construct Wild China" was put forward by 18th CPC National Congress which was just closed. With the development of urbanization, a large number of housing which have not reached their service life are removed due to the damage of the wall insulation veneer, causing serious influence on the green development of city.

Exterior wall insulation includes single material (aerated concrete, sintered insulating brick, etc.) exterior wall insulation and composite material exterior wall insulation (interior thermal insulation, exterior thermal insulation, sandwich thermal insulation and block thermal insulation, etc.). Although there are many ways of exterior wall insulation, few of them realize an integration of decoration and insulation, and in order to meet the decoration requirement, it is necessary to construct a decorative layer on the surface of an insulation layer after construction of the insulation layer. However, since the insulation layer has been constructed on a wall, then it is very inconvenient to add a decorative layer onto the insulation layer.

After much trial and error, the applicant develops an exterior wall insulation board which realizes integration of insulation and decoration. The insulation board comprises a metal veneer and a substrate oppositely arranged with an insulation layer disposed therebetween. The applicant firstly roller coats a multicolor pattern on the metal veneer by using an intaglio printing press, and then glues the metal veneer, the insulation layer and the substrate together to form the exterior wall insulation board which is finally constructed on an exterior wallbody. It provides much more convenience for processing the decorative layer, compared with the traditional way by which an insulation layer is installed firstly followed by constructing a decorative layer. The intaglio printing press used by the applicant for roller coating the multicolor pattern comprises a feeding equipment, used for providing paints; a suction roller, whose circumference surface is in connection with the feeding equipment, and has a plurality of recesses adapted for being filled with paints for forming an image area; and a rubber coating roller, with its circumference surface in connection with the suction roller, and used for receiving and transferring the image area formed by the paints on the coating roller onto a steel plate to form desired multicolor pattern.

However, during the process of using the intaglio printing press, the applicant finds that, the roller surface linear velocity of the suction roller and the rubber coating roller are frequently inconsistent with the process speed of the whole production line, and the whole production line is lack of a control system for on-line adjusting the rotation speed of the suction roller and the rubber coating roller, so the whole production line has to be stopped for adjusting after operation for a period of time, thus affecting the efficiency of the whole production line. If the production line is not stopped for adjusting, the metal plate transporting speed would be inconsistent with the roller surface linear velocity of each roller, thus frequently causing the metal plate unable to be roller coated at a designated position thereof. Besides, in order to print a multicolor pattern, a plurality of roller coating units are required for coordination operation. However, the above mentioned intaglio printing press in the prior art is lack of a control system for allowing a continuous production between adjacent roller coating units, so workers need observe by human eyes if a first roller coating unit has completed coating of one color, and if yes, an adjacent roller coating unit will be started by manual work, thus it is unable to realize a continuous production between the adjacent roller coating units. At the same time, due to lack of the control system for adjusting the rotation speed of the suction roller and the coating roller, it is unable to realize error correction when misplacement occurs between the patterns printed by the adjacent roller coating units.

SUMMARY OF THE INVENTION

Therefore, the technical problem to be solved by the present invention is to provide a roller coating method for production of a patterned insulation board, by which the roller surface linear velocity of each roller of a roller coating unit is able to be adjusted to be consistent with, e.g. equal to, the rotation speed of the process, thus improving the production efficiency.

In order to solve the above mentioned technical problem, in a class of embodiments, the present invention provides a roller coating method for production of patterned insulation board used for building exterior wall, comprising in sequence the following steps:

A. a step of producing a metal veneer and a substrate, and printing pattern on the metal veneer; and B. a step of adding an insulation layer between the metal veneer and the substrate to produce the patterned insulation board;

the production of the metal veneer in step A comprising in sequence the following steps:

a. producing a metal plate;

b. treating the metal plate before printing pattern;

c. performing a first roller coating transfer on the metal plate by using a first roller coating unit;

d. after a specific time, performing a second roller coating transfer on the metal plate by using a second roller coating unit to form a pattern on the metal plate, thus producing the metal veneer; and e. performing a post processing to spray the metal veneer with gloss paint;

In the step c, a servo control system is used to control the first roller coating unit, and the servo control system has a following control process:

S 1. diameter of each roller and a process speed of the first roller coating unit are input into a PLC control module, then the PLC control module calculates out theoretical roller surface linear velocity of each roller according to the process speed and the diameter of each roller, with the theoretical roller surface linear velocity of each roller being calculated to be equal to the process speed, and outputs the calculated theoretical roll surface linear velocity signal of each roller into a servo control module having an encoder;

S2. the servo control module receives the theoretical roll surface linear velocity signal of each roller from the PLC servo control module and drives each roller according to the signal;

S3. the encoder collects actual roller surface linear velocity of each roller and outputs the actual roller surface linear velocity signal of each roller into the PLC control module;

S4. according to the received actual roller surface linear velocity signal and theoretical roller surface linear velocity signal of each roller, the PLC control module adjusts current frequency of electrical machine driving each roller, and adjusts the actual roller surface linear velocity of each roller to be consistent with the theoretical roller surface linear velocity of each roller, and then the roller coating transfer of the first roller coating unit is completed.

In a class of this embodiment, in the step S1 of step c, distance data, e.g. information about the distance, between the first roller coating unit and the second roller coating unit is input into the PLC control module, and on the basis of the process speed and the distance data, the PLC control module calculates out a specific time to start the second roller coating unit, and starts the second roller coating unit according to the specific time, and then the second roller coating transfer of the second roller coating unit is completed.

In a class of this embodiment, after the step S4 of step c, the printed pattern is collected by a code recognition module, and the pattern misplacement distance is determined by a computer, thereby the process speed of the corresponding roller coating unit is corrected.

In a class of this embodiment, in the step a, the metal plate is produced by a process comprising in sequence the following steps: hot rolling steel coils, acid pickling the hot rolled steel coils, cold rolling the acid pickled steel coils, and continuously hot dip galvanizing the cold rolled steel coils to form the metal plate.

In a class of this embodiment, in the step b, before printing the pattern, the metal plate is treated by following treatment process: degreasing treatment, cleaning treatment, pre-drying treatment, passivating treatment, first drying treatment, coating primer paint treatment, baking for curing treatment, and first cooling treatment.

In a class of this embodiment, in the step e, after spraying with gloss paint, a second drying treatment is performed, followed by a second cooling treatment.

In a class of this embodiment, in the step B, the patterned insulation board is produced by a following process: firstly, the metal veneer and the substrate are respectively processed with coating treatment, profiling treatment and gumming treatment, and the insulation layer is processed with gumming treatment, and then the insulation layer is added between the metal veneer and the substrate and is processed with pressing treatment to produce the patterned insulation board.

In a class of this embodiment, in the step B, rock wool with a density of 120 kg/m3 is used as the insulation layer, and the fiber orientation of the rock wool is perpendicular to the metal veneer and the substrate.

In a class of this embodiment, in the steps of c and d, the roller coating unit comprises a feeding equipment, used for providing paints; a suction roller, whose circumference surface is in connection with the feeding equipment, and has a plurality of recesses adapted for being filled with paints for forming an image area; a rubber coating roller, with its circumference surface in connection with the suction roller, and used for receiving and transferring the image area formed by the paints on the coating roller onto a steel plate; a first doctor blade, arranged on a first doctor blade support and contacted with the suction roller at a specific angle, used for scraping off paints outside the image area on the suction roller; and a second doctor blade, arranged on a second doctor blade support and contacted with the coating roller at a specific angle, used for scraping off paints outside the image area on the rubber coating roller.

In a class of this embodiment, the first doctor blade is contacted with the suction roller at an angle less than 30 degrees; and the second doctor blade is contacted with the coating roller at an angle more than 30 degrees.

The present invention providing a roller coating method for production of patterned insulation board used for building exterior wall has advantages in the following:

1. The present invention provides a roller coating method for production of patterned insulation board used for building exterior wall, and in this method a metal veneer and a substrate are produced firstly, and a pattern is printed on the metal veneer, and then an insulation layer is added between the metal veneer and the substrate to produce the patterned insulation board which is finally arranged onto the wall body. In this way, the defect that an decorative layer has to be arranged after installation of an insulation board is avoided (it is inconvenient to directly print a pattern on the insulation board arranged on the wall body by making use of the roller coating production line, so the existing insulation board is generally less decorative and unaesthetic), and the integration of decoration and insulation is realized. And for the first transfer, in one aspect, the PLC control module of the servo control system collects the process speed and the rotation speed of each roller of the roller coating unit, calculates out the theoretical roller surface linear velocity and makes the theoretical roller surface linear velocity be consistent with the process rotation speed; in a further aspect, the actual roller surface linear velocity of each roller of the roller coating unit is collected by a servo control module having an encoder, and the signal of the actual roller surface linear velocity is input into the PLC control system, so that the PLC control system can compare the actual roller surface linear velocity with the theoretical roller surface linear velocity, and adjust current frequency until the actual roller surface linear velocity is consistent with the theoretical roller surface linear velocity. In the above mentioned control method, the actual roller surface linear velocity is adjusted to be consistent with the theoretical roller surface linear velocity which is consistent with the process speed, thus ensuring that the actual roller surface linear velocity is consistent with the process rotation speed, so there is no need to stop the line for adjusting in the production process, thus increasing the production efficiency.

2. The present invention provides a roller coating method for production of patterned insulation board used for building exterior wall. In this method, the distance data between the first roller coating unit and the second roller coating unit is also input into the PLC control module, and on the basis of the process speed and the distance data, the PLC control module is able to calculate out a specific time to start the second roller coating unit. Once the production line is determined, the distance between adjacent units will be determined. The distance data is input into the PLC control module in advance, and then according to the process speed and distance data, the PLC control module calculates out the specific time to start next roller coating unit. Then the specific time to start next roller coating unit is able to be preset, and the next roller coating production line is allowed to be started within the specific time, so a continuous production between the adjacent roller coating units is realized, and the production efficiency is further improved.

3. The present invention provides a roller coating method for production of patterned insulation board used for building exterior wall. In this method, the printed pattern is collected by a code recognition module, and the pattern misplacement distance is determined by computer recognition, and then the process speed of the corresponding roller coating unit is corrected. After next roller coating production line is started and the second transfer is completed, the printed pattern is collected by the code recognition module and the pattern misplacement distance is determined by the computer recognition, and then the rotation speed of each roller is corrected in accordance with the pattern misplacement distance, so that the pattern misplacement is corrected. The above process can be circularly performed, hence ensuring that the printed pattern is lifelike and holonomic. In addition, the length of the printed pattern is extended greatly due to the join of the code recognition module.

4. The present invention provides a roller coating method for production of patterned insulation board used for building exterior wall. In the step a of this method, the metal plate is produced by a process comprising in sequence the following steps: hot rolling steel coils, acid pickling the hot rolled steel coils, cold rolling the acid pickled steel coils, and continuously hot dip galvanizing the cold rolled steel coils to form the metal plate. The hot rolling treatment facilitates the molding of the metal plate, the acid pickling treatment facilitates rust removal and edge cutting, the cold rolling subsequent to the hot rolling facilitates to eliminate pores, and the continuously hot-dip galvanizing treatment subsequent to cold rolling can not only realize annealing effect but also enhance antioxidation property of the metal plate.

5. The present invention provides a roller coating method for production of patterned insulation board used for building exterior wall. In the step b of this method, before printing the pattern the metal plate is treated by following treatment process: degreasing treatment, cleaning treatment, pre-drying treatment, passivating treatment, first drying treatment, coating primer paint treatment, baking for curing treatment, and first cooling treatment. Due to the above preprocessing steps, the adhesive force between the paints and the metal plate to be printed during the roller coating process is effectively increased, and the molding property of the metal veneer is improved.

6. The present invention provides a roller coating method for production of patterned insulation board used for building exterior wall. In the step B of this method, a rock wool with a density of 120 kg/m3 is used as the insulation layer, and the fiber orientation of the rock wool is perpendicular to the metal veneer and the substrate. The strength of the insulation layer is enhanced due to the reasonable selection of density. The fiber orientation of the rock wool is perpendicular to the metal veneer and the substrate, ensuring that the rock wool will not easily slide and dislocate with the metal veneer and the substrate, thus improving the rigidity.

BRIEF DESCRIPTION OF THE DRAWINGS

In order to make the present invention more easily and clearly understood, the invention is further described below in conjunction with the detailed embodiments and the drawings, wherein, FIG. 1 is a schematic view of a roller coating unit of the present invention.

The reference numbers in the drawings represent:

1—feeding equipment; 2—suction roller; 3—rubber coating roller; 4—first doctor blade; 5—second doctor blade; 6—cleaning device; 61—liquid feed tank; 62—transfer pump; 63—transfer pipe; 64—spay pipe; 65—spay hole; 67—recovery tank; 68—filter; 7—support roller

DETAILED DESCRIPTION OF THE EMBODIMENTS

Embodiment 1

This embodiment provides a roller coating method for production of patterned insulation board used for building exterior wall, comprising in sequence the following steps: A. a step of producing a metal veneer and a substrate, and printing pattern on the metal veneer; and B. a step of adding an insulation layer between the metal veneer and the substrate to produce the patterned insulation board. The production of the metal veneer in step A comprises in sequence the following steps of: a. producing a metal plate; b. treating the metal plate before printing pattern; c. performing a first roller coating transfer on the metal plate by using a first roller coating unit; d. after a specific time, performing a second roller coating transfer on the metal plate by using a second roller coating unit to form a pattern on the metal plate, thus producing the metal veneer; and e. performing a post processing treatment to spray the metal veneer with gloss paint.

In the step a, the metal plate is produced by a process comprising in sequence the following steps of: hot rolling steel coils, acid pickling the hot rolled steel coils with hydrochloric acid, cold rolling the acid pickled steel coils, and continuously hot dip galvanizing the cold rolled steel coils at 650° C. (or at other temperatures chosen from 650° C. to 850° C. to form the metal plate. Herein, continuously hot-dip galvanizing at 650° C.) is equivalent to carrying out hot-dip galvanizing treatment subsequent to annealing treatment, improving both mechanical property and antioxidation property.

In the step b, before printing the pattern, the metal plate is treated by following treatment process: degreasing treatment, cleaning treatment, pre-drying treatment, passivating treatment, first drying treatment, coating primer paint treatment, baking for curing treatment, and first cooling treatment. In detail, in the degreasing treatment, an alkali liquor with an concentration of 1% and an temperature of 50-65 degrees is used to perform degreasing so as to remove oil and dust on the surface of the strip steel, and in the alkali liquor, the ratio of total alkali to free alkali is less than 2.5. In the cleaning treatment, desalted water having a temperature of 50-65 degrees and a PH value less than 7.8 is used to wash the surface of the strip steel after degreasing treatment, so as to remove residual alkali liquor on surface of the strip steel. In the pre-drying treatment, hot air having a temperature of 75-85 degrees heated by a vapor heat exchanger is used to dry the surface of the strip steel after cleaning so as to remove residual water thereon. In the passivating treatment, the surface of the strip steel after cleaning is passivated with a treating solution having Chromium point of 22-32, so as to increase the adhesion force between the strip steel and the primer paint and also increase the antiseptic property. In the first drying treatment, the passivated surface is dried by an electrical heating oven at a baking temperature of 75-85 degrees to enhance passivation effect. In the coating primer paint treatment, the first roller coating unit is used to coat primer paint and back paint on the surface of the strip steel, and the color and property of the primer paint depend on the pattern to be printed. In the baking for curing treatment and first cooling treatment, the strip steel coated with the primer paint and back paint is baked to allow the primer paint and back paint fully cure at temperature of 214-232 degrees, then the strip steel is cooled by water spay and flow to further stabilize the property of the primer paint and back paint.

In the present embodiment, in order to improve brightness of the pattern and protection for the pattern, a post processing treatment is performed to the metal plate in the step e, and the post processing treatment comprises steps of: spraying gloss paint on the surface of the metal plate, then performing a second drying treatment, followed by a second cooling treatment.

In the present embodiment, in the steps of c and d, the first roller coating unit is controlled by a servo control system to form a two-color pattern on the metal plate. The control process is described in detail as below:

S 1. diameter of each roller and a process speed of the first roller coating unit are input into a PLC control module, whereby the PLC control module calculates out theoretical roller surface linear velocity of each roller (Theoretical rotation speed=process speed/π*diameter of each roller, Theoretical roller surface linear velocity=theoretical rotation speed*roller diameter*π), with the theoretical roller surface linear velocity of each roller to be consistent with, e.g. being calculated to be equal to the process speed, and outputs the calculated theoretical roll surface linear velocity signal of each roller into a servo control module having an encoder;

S2. the servo control module receives the theoretical roll surface linear velocity signal of each roller from the PLC control module and drives each roller according to the signal;

S3. the encoder collects actual roller surface linear velocity of each roller and output the actual roller surface linear velocity signal of each roller into the PLC control module;

S4. according to the received actual roller surface linear velocity signal and theoretical roller surface linear velocity signal of each roller, the PLC control module adjusts current frequency of electrical machine driving each roller, and adjusts the actual roller surface linear velocity of each roller to be consistent with the theoretical roller surface linear velocity of each roller, and then the roller coating transfer of the first roller coating unit is completed.

In the present embodiment, in order to realize continuous operation of adjacent roller coating units on line, in the step S 1, distance data, e.g. information about the distance, between the first roller coating unit and the second roller coating unit is input into the PLC control module, and on the basis of the process speed and the distance data, the PLC control module calculates out a specific time to start the second roller coating unit, and starts the second roller coating unit according to the specific time, and then the second roller coating transfer of the second roller coating unit is completed.

In the present embodiment, in order to print irregular long pattern, after completing the printing of the second roller coating unit, that is, after the step S4, the printed pattern is collected by a code recognition module, and the pattern misplacement distance is determined by a computer recognition system, and then the process speed of the corresponding roller coating unit is corrected. The correction process is described in detail as below. If the actual position of a latter printed color in the pattern collected by the code recognition module misplaces a distance from the predetermined position of the latter printed color relative to the former printed color, for example, the actual position locates at 10 mm ahead of the predetermined position, which indicates that the actual process speed (denoted by V1) of the roller delivering the metal plate speeds up 10 mm per unit time relative to the theoretical process speed (denoted by V2), that is at this time, V2=V1−10. thus calculating out V2. Then the calculated V2 is converted into the theoretical rotation speed of the roller (denoted by N) via the formula N=V2/π*roller diameter, thereby adjusting the current frequency of the corresponding electric machine in accordance with rotation speed N, thus the rotation speed of the corresponding roller will be adjusted, and further the process speed will be adjusted, and finally the pattern misplacement accuracy is controlled within ±0.6 millimeter. This adjusting process is a dynamic and repeated process.

Herein, the printed pattern is collected by a digital video comprised in the code recognition module.

It should be noted that, for the production method of the present invention described above, roller coating units are required for carrying out the steps c and d, but there is no limitation on the specific structural of the roller coating units.

It should be noted that, the present embodiment provides a method for production of two-color patterned metal veneer, which requires two roller coating units. While on the basis of the production method of the present embodiment, in particular of the techniques for adjusting rotation speed, time for starting the second roller coating unit, and the code recognition in the servo control system, modifications can be made by those skilled in the art so as to produce metal veneer with pattern in three-, four-, five- or more color.

In the present embodiment, the production process of the step B is described in detail as below. Firstly, the metal veneer and the substrate are respectively processed with coating treatment, profiling treatment and gumming treatment, and the insulation layer is processed with gumming treatment, and then the insulation layer is added between the metal veneer and the substrate and is processed with pressing treatment to produce the patterned insulation board. A rock wool with a density of 120 kg/m3 is used as the insulation layer, and the fiber orientation of the rock wool is perpendicular to the metal veneer and the substrate. A polyurethane foaming agent is used in the gumming treatment. In order to improve the waterproof property, after the insulation layer is added between the metal veneer and the substrate and is processed with pressing treatment to produce the patterned insulation board, a polyurethane foaming agent is used for sealing edge of the patterned insulation board.

Embodiment 2

The present embodiment provides a structure of the roller coating unit used in the steps c and d in the embodiment 1. As shown in FIG. 1, the roller coating unit comprises a feeding equipment 1 used for providing paints; a suction roller 2, whose circumference surface is in connection with the feeding equipment 1, and has a plurality of recesses adapted for being filled with paints for forming an image area; a rubber-coating roller 3, with its circumference surface in connection with the suction roller 2, used for receiving and transferring the image area formed by the paints on the coating roller 3 onto a steel plate; a first doctor blade 4, arranged on a first doctor blade support and contacted with the suction roller 2 at a specific angle, used for scraping off paints outside the image area on the suction roller 2; and a second doctor blade 5, arranged on the second doctor blade support and contacted with the coating roller 3 at a specific angle, used for scraping off paints outside the image area on the rubber coating roller 3.

The working process of the roller coating unit in the present embodiment is described as below. The suction roller 2 moves, and the feeding equipment 1 supplies the suction roller 2 with paints. A part of the paints gets into the recesses used for forming an image area on the suction roller 2, and another part of the paints locates outside the recesses on the suction roller 2. The paints outside the recesses on the suction roller 2 is scraped off by the first doctor blade 4, then the suction roller 2 rotates to transfer the paints in the recesses onto the rubber-coating roller 3 to form an image area. Then the paints outside the image area on the rubber coating roller 3 is scraped off by the second doctor blade, then the rubber coating roller 3 rotates to transfer the image area onto the metal plate to be printed to form a pattern. The metal plate to be printed is supported by a support roller 7 which also provides a supporting force for the coating operation of the rubber coating roller.

The control process of printing pattern on the metal plate by using the roller coating unit of the present embodiment is described in detail as below.

S1, the diameters of the suction roller 2 and the coating roller 3 and the process speed of the first roller coating unit are input into the PLC control module, then the PLC control module calculates out the theoretical roller surface linear velocity of the suction roller 2 and the coating roller 3 according to the process speed and the diameter of the suction roller 2 and the coating roller 3, allows the theoretical roller surface linear velocity of the suction roller 2 and the coating roller 3 to be consistent with the process speed, and outputs the calculated theoretical roller surface linear velocity signal of the suction roller 2 into a first servo control module having a first encoder, and outputs the theoretical roller surface linear velocity signal of the coating roller 3 into a second servo control module having a second encoder;

S2, the first servo control module receives the theoretical roller surface linear velocity signal of the suction roller 2 from the PLC control module and drives the suction roller 2 according to the signal; and the second servo control module receives the theoretical roller surface linear velocity signal of the coating roller 3 from the PLC control module and drives the coating roller 3 according to the signal;

S3, the first encoder collects the actual roller surface linear velocity of the suction roller 2 and outputs the actual roller surface linear velocity signal of the suction roller 2 into the PLC control module, and the second encoder collects the actual roller surface linear velocity of the coating roller 3 and outputs the actual roller surface linear velocity signal of the coating roller 3 into the PLC control module; and S4, according to the received actual roller surface linear velocity signal and the theoretical roller surface linear velocity signal of the suction roller 2 and the coating roller 3, the PLC control module adjusts current frequency of electrical machine driving each roller, and adjusts the actual roller surface linear velocity of the suction roller 2 and the coating roller 3 to be consistent with the theoretical roller surface linear velocity of the suction roller 2 and the coating roller 3, and then the roller coating transfer of the first roller coating unit is carried out and completed.

The rubber coating roller 3 of the roller coating unit of the present embodiment is made from rubber, and such a structure design allows the rubber coating roller to flexibly contact with the suction roller 2 and the steel plate to be printed respectively, thus ensuring an exactly matching contact. In this way, the image area on the suction roller 2 can be completely transferred onto the rubber coating roller 3, and the image area on the rubber coating roller 3 can be completely transferred onto the steel plate to be printed, thus forming a complete image area. Moreover, the intaglio printing press provided in the present embodiment comprises a first doctor blade 4 and a second doctor blade 5 (FIG. 1 is a schematic diagram showing the first doctor blade 4 in contact with the suction roller 2 and the second doctor blade 5 in contact with the rubber coating roller 3). The first doctor blade 4 is used to scrape off the paints outside the recesses on the suction roller 2, and the second doctor blade 5 is used to scrape off the paints outside the image area on the rubber coating roller 3, thus avoiding the defect of lower labor efficiency caused by manual scrape, thereby improving labor efficiency. In addition, the first doctor blade 4 and the second doctor blade 5 are contacted with the suction roller 2 and the rubber coating roller 3 at a specific angle respectively, which can ensure better effect of scrape and prolong the service life of the doctor blade.

In the present embodiment, the first doctor blade 4 and the second doctor blade 5 are respectively in fixed connection with a support having adjustable height and angle. Furthermore, an example realizing adjustable height and angle is described below. Both ends of the doctor blade are respectively fixed with a slide guide which can moves up and down, and the up and down movements of the slide guide is adjusted by a turbine worm device connected therewith, and the turbines and worms at both ends are connected together by a rigid linkage, and the worms are driven to rotate by adjusting a handle, thus realizing up and down movements of the doctor blade. Both ends of the doctor blade are respectively provided with a ruler showing height, used for showing adjustment magnitude. An example realizing adjustable angle is described below. The slide guides at both ends of the doctor blade respectively comprises an articulated mechanism at a lower end of the slide guide, and the slide guide is rotatable along the articulated mechanism, and the rotation of the slide guide is adjusted by an adjusting screw rod. The adjusting screw rod is manually operated to rotate by using an adjusting wrench. A ruler with angle index is provided nearby the slide guide, used for showing the rotation angles.

It should be noted that, the coating roller may also be made from other materials as well as rubber, as long as the materials can ensure normal coating and flexible contact with the suction roller and the steel plate to be printed, such as silicone products which can meet requirements for elasticity, hardness and transfer property during coating.

In the present embodiment, the first doctor blade 4 is contacted with the suction roller 2 at an angle less than 30 degrees, and the second doctor blade 5 is contacted with the coating roller 3 at an angle more than 30 degrees. During intaglio printing process, paints that need to be scraped off are located on different positions at a same moment, so the first doctor blade 4 and the second doctor blade 5 are set at different angles, thus ensuring paints on the suction roller 2 and the coating roller 3 can be scraped off at a same time.

In the present embodiment, the first doctor blade 4 is made from titanium steel plate and has a blade thickness of 0.3 mm, and the second doctor blade 5 is made from titanium steel plate and has a blade thickness of 0.3 mm.

In the present embodiment, in order to improve the properties of the roller coating unit, a cleaning device 6 is provided for cleaning the paints on second doctor blade 5 and the rubber coating roller 3. The cleaning device 6 comprises a liquid feed tank 61, a transfer pump 62 used for pumping the cleaning liquid in the liquid feed tank 61, a cleaning liquid transfer pipe 63 communicated with the cleaning liquid transfer pump 62, and a spray pipe 64 communicated with the cleaning liquid transfer pipe. The spray pipe 64 is arranged above the rubber coating roller 3 in the axial direction and has a plurality of spray holes 65 thereon. The cleaning device 6 further comprises a cleaning liquid recovery tank 66, arranged below the coating roller 3 and connected with a recovery pipe 67 leading to the liquid feed tank 61. A filter 68 is arranged between the recovery pipe 67 and the liquid feed tank 61.

The working process of the cleaning device provided in the present embodiment is described as below.

When at work, the cleaning liquid in the liquid feed tank 61 is pumped to the spray pipe 64 by the transfer pump 62, and is sprayed through the spray holes 65, subsequently the cleaning liquid flows over the rubber coating roller 3 and flows into the recovery tank 66, then passes through the recovery pipe 67 and is filtered by the filter 68, and finally gets back to the liquid feed tank 61 for recycling.

In the present embodiment, the feeding equipment 1 is a tray with a groove.

While particular embodiments of the invention have been shown and described, it will be obvious to those skilled in the art that changes and modifications may be made without departing from the invention in its broader aspects, and, therefore, the aim of the appended claims is to cover all such changes and modifications as fall within the true spirit and scope of the invention.

The invention claimed is:

1. A roller coating method for production of patterned insulation board used for building exterior wall, comprising in sequence the following steps:

A. a step of producing a metal veneer and a substrate, and printing pattern on said metal veneer; and B. a step of adding an insulation layer between said metal veneer and said substrate to produce the patterned insulation board;

the production of the metal veneer in step A comprising in sequence the following steps of:

a. producing a metal plate;

b. treating said metal plate before printing pattern;

c. performing a first roller coating transfer on said metal plate by using a first roller coating unit;

d. after a specific time, performing a second roller coating transfer on said metal plate by using a second roller coating unit to form a pattern on the metal plate, thus producing the metal veneer; and e. performing a post processing treatment to spray said metal veneer with gloss paint;

wherein:

in the step a, the metal plate is produced by a process comprising in sequence the following steps of: hot rolling steel coils, acid pickling the hot rolled steel coils, cold rolling the acid pickled steel coils, and continuously hot dip galvanizing the cold rolled steel coils at temperatures chosen from 650° C. to 850° C. to form the metal plate;

in the step b, before printing the pattern, said metal plate is treated by following treatment process: degreasing treatment, cleaning treatment, pre-drying treatment, passivating treatment, first drying treatment, coating primer paint and back paint treatment, baking for curing treatment, and first cooling treatment, wherein, in the degreasing treatment, an alkali liquor with a temperature of 50-65° C. is used to perform degreasing and the alkali liquor with a ratio by volume of total alkali to free alkali less than 2.5 is used, in the cleaning treatment, desalted water having a temperature of 50-65° C. and a PH value less than 7.8 is used to wash the surface of the strip steel, in the pre-drying treatment, hot air having a temperature of 75-85° C. heated by a vapor heat exchanger is used to dry the surface of the strip steel, in the passivating treatment, the surface of the strip steel after cleaning is passivated with a treating solution having Chromium point of 22-32 mL, in the first drying treatment, the passivated surface is dried by an electrical heating oven at a baking temperature of 75-85° C., in the baking for curing treatment and first cooling treatment, the strip steel coated with the primer paint and back paint is baked to allow the primer paint and back paint to fully cure at temperature of 214-232° C.;

in the step c, a servo control system is used to control the first roller coating unit, and said servo control system has a following control process:

S1. diameter of each roller and a process speed of said first roller coating unit are input into a PLC control module, then the PLC control module calculates out theoretical roller surface linear velocity of each roller according to the process speed and the diameter of each roller with the theoretical roller surface linear velocity of each roller being calculated to be equal to the process speed, and outputs the calculated theoretical roll surface linear velocity signal of each roller into a servo control module having an encoder;

S2. the servo control module receives the theoretical roll surface linear velocity signal of each roller from the PLC control module and drives each roller according to the signal;

S3. the encoder collects actual roller surface linear velocity of each roller and outputs the actual roller surface linear velocity signal of each roller into the PLC control module;

S4. according to the received actual roller surface linear velocity signal and theoretical roller surface linear velocity signal of each roller, the PLC control module adjusts current frequency of electrical machine driving each roller, and adjusts the actual roller surface linear velocity of each roller to be consistent with the theoretical roller surface linear velocity of each roller, and then the roller coating transfer of the first roller coating unit is completed, after the step S4 of step c, the printed pattern is collected by a code recognition module, and pattern misplacement distance is determined by computer recognition, and then the process speed of the corresponding roller coating unit is corrected.

2. The method of claim 1, wherein, in the step S1 of step c, data information about the distance between said first roller coating unit and said second roller coating unit is input into said PLC control module, and on the basis of the process speed and the data information about the distance, the PLC control module calculates out a specific time to start the second roller coating unit, and starts the second roller coating unit according to the specific time, and then the second roller coating transfer of the second roller coating unit is completed.

3. The roller coating method of claim 1, wherein, in the step e, after spraying with gloss paint, a second drying treatment is performed, followed by a second cooling treatment.

4. The roller coating method of claim 1, wherein, in the step B, the patterned insulation board is produced by a following process: firstly, the metal veneer and the substrate are respectively processed with coating treatment, profiling treatment and gumming treatment, and the insulating layer is processed with gumming treatment, and then the insulation layer is added between the metal veneer and the substrate and is processed with pressing treatment to produce the patterned insulation board.

5. The roller coating method of claim 4, wherein, in the step B, rock wool with a density of 120 kg/m3 is used as the insulation layer, and the fiber orientation of the rock wool is perpendicular to the metal veneer and the substrate.

6. The roller coating method of claim 5, wherein, in the step B, a polyurethane foaming agent is used in the gumming treatment.

7. The roller coating method of claim 6, wherein, in the step B, after the insulation layer is added between the metal veneer and the substrate and is processed with pressing treatment to produce the patterned insulation board, a polyurethane foaming agent is used for sealing edge of the patterned insulation board.

* * * * *